US007470171B2

(12) United States Patent
Zhang

(10) Patent No.: US 7,470,171 B2
(45) Date of Patent: Dec. 30, 2008

(54) SURFACE POLISHING METHOD AND APPARATUS THEREOF

(75) Inventor: Jun Zhang, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/331,166

(22) Filed: Jan. 13, 2006

(65) Prior Publication Data

US 2006/0172663 A1 Aug. 3, 2006

(30) Foreign Application Priority Data

Jan. 14, 2005 (JP) ..... 2005-008335

(51) Int. Cl.
*B24B 1/00* (2006.01)
*H01L 21/203* (2006.01)

(52) U.S. Cl. ..... 451/41; 438/690; 451/56

(58) Field of Classification Search ..... 451/5, 451/8, 41, 56; 438/690–693
See application file for complete search history.

(56) References Cited

U.S. PATENT DOCUMENTS

| | | | | |
|---|---|---|---|---|
| 6,099,394 | A * | 8/2000 | James et al. | 451/72 |
| 6,126,514 | A * | 10/2000 | Muroyama | 451/36 |
| 6,390,890 | B1 * | 5/2002 | Molnar | 451/41 |
| 6,656,023 | B1 * | 12/2003 | Molnar | 451/41 |
| 6,702,646 | B1 * | 3/2004 | Gitis et al. | 451/5 |
| 6,739,947 | B1 * | 5/2004 | Molnar | 451/8 |
| 6,910,951 | B2 * | 6/2005 | Balijepalli et al. | 451/41 |
| 6,931,330 | B1 * | 8/2005 | Yi et al. | 702/41 |
| 2002/0137434 | A1 * | 9/2002 | Choi et al. | 451/28 |
| 2004/0040216 | A1 | 3/2004 | Endoh et al. | |
| 2004/0166779 | A1 * | 8/2004 | Balijepalli et al. | 451/41 |

FOREIGN PATENT DOCUMENTS

| | | | |
|---|---|---|---|
| JP | 64-058463 | | 3/1989 |
| JP | 64-58463 | * | 3/1989 |
| JP | 10-296610 | | 11/1998 |
| JP | 2003-11062 | | 1/2003 |
| JP | 2003-11063 | | 1/2003 |
| JP | 2003-62754 | | 3/2003 |
| JP | 2003-105324 | | 4/2003 |
| JP | 2004-17165 | | 1/2004 |
| JP | 2004-82323 | | 3/2004 |
| JP | 2004-106121 | | 4/2004 |
| JP | 2004-160628 | | 6/2004 |

OTHER PUBLICATIONS

Chinese First Action, with translation, submitted by applicant.*

* cited by examiner

*Primary Examiner*—Maurina Rachuba
(74) *Attorney, Agent, or Firm*—Oblon, Spivak, McClelland, Maier & Neustadt, P.C.

(57) ABSTRACT

A surface polishing method that polishes the surface of a hard brittle material, such as a glass substrate, an oxide film of a silicon wafer, and a ceramic substrate is disclosed. In the surface polishing method, a fixed abrasive grain polishing tool is used, in which the fixed abrasive grains are a porous substance of granule type in which many primary grains are partially bonded with each other with spaces among them without having the binder therein. The surface polishing method includes the steps of supplying loose abrasive grain slurry between the fixed abrasive grain polishing tool and a surface to be polished of an object, and dressing the top parts of the abrasive grains of the fixed abrasive grain polishing tool which parts contact the surface to be polished of the object by the supplied loose abrasive grains.

6 Claims, 6 Drawing Sheets

(130minutes)

(120minutes)

SURFACE POLISHING METHOD AND APPARATUS THEREOF

BACKGROUND OF THE INVENTION

1. Field of the Invention

The present invention generally relates to a surface polishing method and an apparatus thereof which apparatus polishes the surface of a hard brittle material, such as silicon and glass, and a metal material, such as steel and aluminum by using a polishing tool; and in particular, an apparatus that can stably execute a high quality polishing process with high efficiency for a long time. These method and apparatus can be effectively applied to a surface polishing process for a glass product and a surface flattening process for a semiconductor device wafer.

2. Description of the Related Art

In order to flatten the surface of a component made of a hard brittle material such as a silicon wafer and a glass disk, a polishing process is executed by using loose abrasive grains. However, in the process, problems, such as warp, roll, and generation of steps on the surface, are liable to occur, and the problems reduce the accuracy of the polished surface shape.

In order to solve these problems, development of a fixed abrasive grain polishing tool (for example, a grinding stone) which can obtain good finished surface smoothness equal to that obtained by conventional polishing has been actively realized. That is, a highly accurate shape can be obtained by the fixed abrasive grain polishing tool. However, the fixed abrasive grain polishing tool, such as the grinding stone, has various defects. As representative defect examples, there are occurrence of swarf clogging the surface of the grinding stone, dulling of the grinding stone in the polishing process. Consequently, predetermined polishing characteristics cannot be maintained. Therefore, generally, dressing the grinding stone must be executed by a mechanical or an electrical method.

In addition, in order to solve the above problem, for example, in Patent Document 1, as a dressing method for a polishing tape, high pressure cleaning liquid is ejected from a nozzle onto the polishing surface of the polishing tape. The cleaning liquid becomes fog droplets in the air by being ejected at high pressure, the fog droplets crash against the polishing tape, and the polishing swarf clogging the polishing tape is forced out from the polishing tape. However, by this process, the apparatus becomes complex, and a large shock and resulting vibration are received by the polishing tape. Consequently, it is difficult to realize high surface shape accuracy.

Further, in Patent Document 2, a method of polishing an object by supplying loose abrasive grains to a polishing wheel being a fixed abrasive grain polishing tool is disclosed. In this polishing process, instead of performing dressing with a conventional dresser, loose abrasive grains are used together with the fixed abrasive grain polishing tool, and fixed abrasive grains worn down in the polishing wheel are dropped from a binder and clogging of holes is prevented. Further, this document teaches that the loose abrasive grains are sequentially supplied to the parts from which the worn grains are dropped, and high polishing ability can be maintained.

In this method, hastening the dropping of the fixed abrasive grains in the surface layer of the polishing wheel is executed and the parts from which the worn grains are dropped and the hole parts hold the loose abrasive grains. However, there is no difference from a conventional polishing cloth (polishing pad), and it is considered that the mixing effect of the loose abrasive grains with the fixed abrasive grain polishing tool cannot be fully obtained.

For the above reasons, as a result of various research activities, in order to obtain long time polishing life, maintaining high polishing surface quality (scratch-free surface, highly accurate shape), realizing high processing efficiency, it is found that applying the fixed abrasive grains with the loose abrasive grains onto a surface of an object to be processed is effective. That is, in the process, without dropping the fixed abrasive grains from the binder, the tips on the top of the fixed abrasive grains are worn down and flattened, and the generation of fine cutting edges on the fixed abrasive grains is always obtained. Therefore, the mixing effect of the fixed abrasive grains together with the loose abrasive grains on a surface of an object to be processed is always maintained. In addition, because the tips on the top of the fixed abrasive grains are worn down and flattened by the supplied loose abrasive grains, and the commonly-used sophisticated dressing methods are not necessary. That is to say, in the process, there is no need to provide the dressing process that requires profound knowledge and experience.

[Patent Document 1] Japanese Laid-Open Patent Application No. 2004-160628

[Patent Document 2] Japanese Laid-Open Patent Application No. 10-296610

SUMMARY OF THE INVENTION

In preferred embodiments of the present invention, there is provided a surface polishing method and an apparatus thereof in which excellent polished surface roughness of nm order is stably obtained with stable high processing efficiency for a long time.

That is, according to the embodiments of the present invention, there is provided a surface polishing method and an apparatus thereof in which the tips of fixed abrasive grains are worn down and flattened, the generation of fine cutting edges is always obtained, and the mixing effect of the fixed abrasive grains with loose abrasive grains on a surface to be polished of an object is always maintained without dropping the fixed abrasive grains from a binder. Further, according to the embodiments of the present invention, there is provided a surface polishing method and an apparatus thereof in which higher polishing efficiency and longer service life than those by a conventional polishing tool are realized without damaging the excellent polished surface of nm order by focusing on the dressing effect of the loose abrasive grains on the fixed abrasive grains.

Features and advantages of the present invention are set forth in the description that follows, and in part will become apparent from the description and the accompanying drawings, or may be learned by practice of the invention according to the teachings provided in the description. Objects as well as other features and advantages of the present invention will be realized and attained by a surface polishing method and an apparatus thereof particularly pointed out in the specification in such full, clear, concise, and exact terms as to enable a person having ordinary skill in the art to practice the invention.

To achieve these and other advantages in accordance with the purpose of the present invention, according to one aspect of the present invention, there is provided a surface polishing method that polishes the surface of a hard brittle material, such as a glass substrate, an oxide film of a silicon wafer, and a ceramic substrate. In the surface polishing method, a fixed abrasive grain polishing tool is used, in which the fixed abrasive grains are a porous substance of granule type in which many primary grains are partially bonded with each other with spaces among them without having the binder therein. The surface polishing method includes the steps of supplying loose abrasive grain slurry between the fixed abrasive grain polishing tool and a surface to be polished of an object, and dressing the top parts of the abrasive grains of the fixed abrasive grain polishing tool which parts contact the surface to be polished of the object by the supplied loose abrasive grains.

By this aspect, the tips of fixed abrasive grains (abrasive grains in the fixed abrasive grain polishing tool) are worn down and flattened by the supplied loose abrasive grains. With this, the generation of fine cutting edges on the top of the fixed abrasive grains is obtained, and the fixed abrasive grains having the fine cutting edges and the loose abrasive grains are simultaneously applied onto the surface of the object to be polished. In addition, the dressing method is different from the conventional method, that is, the fixed abrasive grains are not dropped from the binder, and parts of the fixed abrasive grains which contact the surface to be polished of the object are dressed by the supplied loose abrasive grains.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1:
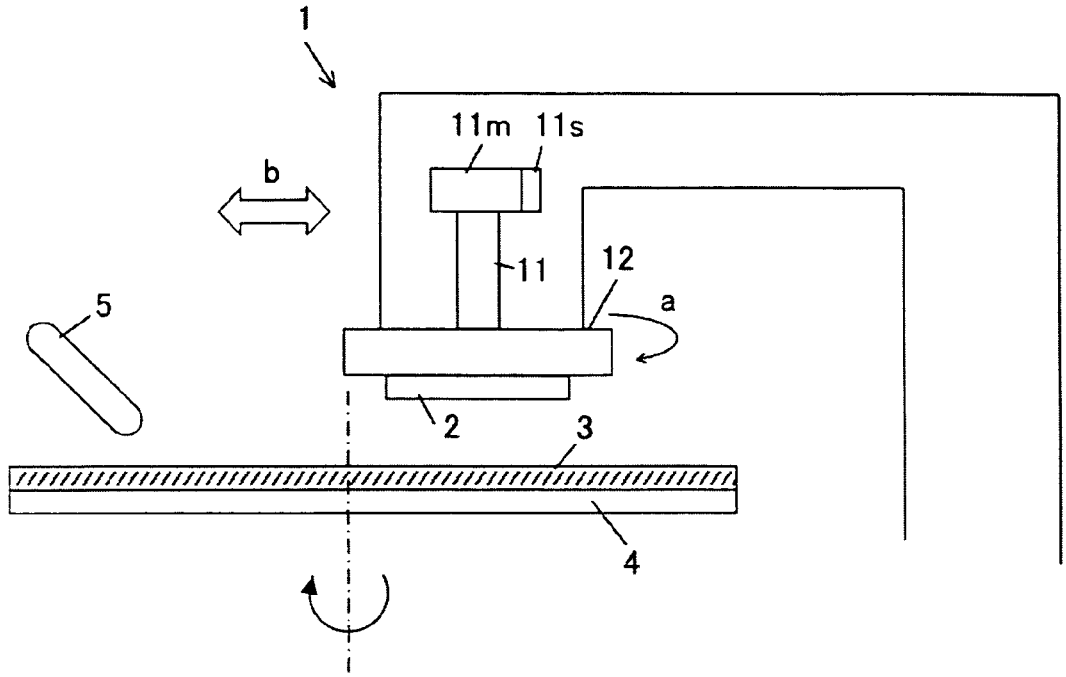
FIG. 1 is a schematic side diagram of a surface polishing apparatus according to a first embodiment of the present invention.

[Best Mode of Carrying Out the Invention]

A best mode of carrying out the present invention is described with reference to the accompanying drawings.

In the embodiments of the present invention, there are the following specific examples, as fixed abrasive grains, a base material, and a binder.

A. As primary grains for the fixed abrasive grains, it depends on an object to be processed; however, generally, a hard inorganic material is used and super fine grains whose average grain diameter is 5 μm or less is preferable. Materials suitable for the fixed abrasive grains are silica, ceria, diamond, CBN, alumina, silicon carbide, zirconium oxide, and so on. The agglomeration of the super fine abrasive grains in which the super fine abrasive grains are partially bonded with each other with spaces among them can be formed by a method such as a sol-gel method, a spray drier method, and a sintering method.

B. As the base material, a soft material such as polyethylene, polypropylene, cloth, non-woven fabric cloth, and a material combining any of the above is used.

C. As the binder, a material such as a urethane resin and a polyester resin is used.

FIRST EMBODIMENT

The fixed abrasive grains in the first embodiment are formed by the following processes.

First, super fine $ZrO_2$ (zirconium oxide) powder particles of 50 to 60 nm are made into slurry by using water, the slurry is sprayed by a spray drier, and secondary grains having a desirable size are obtained. For example, secondary grains (granules) whose average grain diameter D50 is 60 μm are obtained. Generally, secondary grains whose grain diameters range from 1 μm to 300 μm are obtained; when the grain size distribution is not sharp, a classification process is applied and a desirable grain size is obtained. In the embodiment, the average grain diameter of the fixed abrasive grains is controlled to be from 20 μm to 200 μm. The average grain diameter is measured in a dry atmosphere by using a laser diffraction/scattering type grain size distribution measuring instrument LA-920 of Horiba Manufacturing Corp. The value of the average grain diameter is obtained at a point where the accumulated frequency becomes 50% (generally, it is referred to as a median diameter). However, in some cases, the binding power of the primary grains formed by the general spray drier method is too small. Therefore, corresponding to necessity, the $ZrO_2$ granules are input to an electric furnace and sintering is applied to the $ZrO_2$ granules. Further, in order to shorten the sintering time or further harden the $ZrO_2$ granules, pressure can be applied.

The primary grains 21 (refer to FIG. 4A) are grown by a heating process. The primary grains 21 are grown by the mass transfer of the internal substances, one part binding the primary grains 21 becomes thick by the mass transfer of the internal substances and becomes a gentle curved surface without having a discontinuous point, and the other part binding the primary grains 21 becomes a so-called neck shape (hyperboloid of one sheet shape; drum shape). The growing of the primary grains by the mass transfer of the internal substances and the forming of necks are described in "2.3 Mechanism of Mass Transfer and Sintering Model" of "Ceramic Material Technology" published by Industrial Technology Center Corp., 1979. In the sintering process, the neck is formed at the binding part between the primary grains by controlling the heating temperature and sustaining time, and a porous substance of granule type in which the many primary grains are partially bonded with each other with spaces among them is formed (refer to the left side of FIG. 4A).

In order to evaluate the binding strength of the compound secondary grains obtained by the sintering process, a compression to failure test is executed for picking up each secondary grain. The compression to failure test is executed based on a report by Hiramatsu, Oka, and Kiyama described in Journal of the Mining and Metallurgical Institute of Japan, 1965, by using a mini compression to failure test machine MCTM500PC of Shimadzu Corp. The following are test conditions: the test force is 10 to 1000 mN, the load speed is 0.446 mN/sec, the compression to failure test is executed by using a flat surface indenter, and the strength is measured when the grain is broken. By the compression to failure test, the fixed abrasive grains 20 whose compression to failure strength is 67 MPa are selected. In the embodiment, 20 MPa to 160 MPa of the compression to failure strength of the fixed abrasive grains is preferable. The selected fixed abrasive grains 20 are mixed with a urethane resin 24 of a liquid type, and further, an organic solvent is added. After adjusting the solution viscosity, a mixture is made by mixing the above for approximately 10 minutes by using a mixer. The mixing is executed at 50 rpm and room temperature. Then, the liquid containing the abrasive grains is applied on a base material 23 (for example, PET film of approximate 75 μm thickness) by using a wire bar coater. As to the coater, in addition to the wire bar coater, there are a gravure coater, a reverse roll coater, and a knife coater. Any one of them can be used. The item formed by the above processes in which the abrasive grains are applied on the base material is dried in a constant temperature oven (a product of Yamato Science Corp.) for approximate 30 minutes at an approximate temperature of 60° C. With this, a fixed abrasive grain polishing tool 3 is made. By the drying process, the urethane resin liquid 24 is dried. Further, since the average diameter of the fixed abrasive grains 20 is 20 μm to 200 μm, a sufficient protrusion (sticking out) amount of the fixed abrasive grains can be obtained (refer to FIG. 4A), and the maximum height of a roughness carved parameter Rz (JIS B0601:2001) of the fixed abrasive grain polishing tool 3 is in a range between 10 μm and 120 μm.

FIG. 1 is a schematic side diagram of a surface polishing apparatus 1 according to the first embodiment of the present invention. As shown in FIG. 1, the fixed abrasive grain polishing tool 3 is stuck on a plate 4. A silica glass substrate 2 whose diameter is about 5 cm (2 inches) is attached to a work holding mechanism 12 of the surface polishing apparatus 1 and is rotated about a rotary shaft 11. The silica glass substrate 2 is a work piece whose surface to be processed is approximate 30 nmRy.

The silica glass substrate 2 being the work piece is pushed to contact the fixed abrasive grain polishing tool 3 by predetermined pressure and is rotated (sign "a" in FIG. 1) and is reciprocated (sign "b" in FIG. 1). With the above processes, the surface of the silica glass substrate 2 is polished. During the polishing process, loose abrasive grains 22 (refer to FIG. 4A) to which a surface active agent is added are supplied from a nozzle 5.

As the surface active agent, various kinds of agents can be used. For example, there are mono carboxylic acid, dicarboxylic acid, fatty acid system surface active agents, sorbitan fatty acid ester system agents, glycerin ester system agents, and polyoxyethylene sorbit fatty acid ester system agents. As the fatty acid system surface active agents, there are butylic acid, hexanoic acid, octanoic acid, decanoic acid, lauric acid, palmitic acid, oleic acid, linoleic acid, linolenic acid, ricinolic acid, steralic acid, 12-hydroxystearic acid, naphthenic acid, dimmer acid, ricinolic acid condensation, alkylsuccinic acid, an alkaline metal of fatty acid such as sulfide fatty acid, and alkanolamine. In addition, as the sorbitan fatty acid ester system agents, there are monooleic acid sorbitan, sesquioleic acid sorbitan, trioleic acid sorbitan, monoisostearic acid sorbitan, and sesquisostealic acid sorbitan. Further, as the glycerin ester system agents, there are pentaoleic acid decaglyceryl, pentaisostearic acid decaglyceryl, monoisostearic acid glyceryl, trioleic acid decaglyceryl, pentaoleic acid hexadecaglyceryl, and monoisostearic acid diglyceryl. Moreover, as the polyoxyethylene sorbit fatty acid ester system agent, there is tetraoleic acid POE sorbit. As the surface active agent, a single agent or an agent in which two or more agents are mixed can be used.

In the first embodiment, as the loose abrasive grains 22, cerium oxide slurry of ph 11 to which nitrilotri ethanol is added is simultaneously supplied in the amount of 200 ml/minute at the polishing; in this, the grain diameter of the cerium oxide is 0.1 to 2.0 μm.

Polishing resistance is measured by using a meter (sensor). As the meter, a distortion meter and an ammeter can be used. In the first embodiment, changes of a driving current of a motor 11*m* which drives the rotary shaft 11 are measured by using an ammeter 11*s*. The polishing resistance is calculated from the measured current values. In a case where a distortion meter is used, distortions of the rotary shaft 11 during the rotation are electrically measured by the distortion meter, and the polishing resistance is calculated from the measured results. In addition, during the polishing of the surface of the silica glass substrate 2, the polishing is stopped at a predetermined interval, and polishing efficiency is measured by the measurement of the surface roughness and the change of the weight of the silica glass substrate 2 (work piece).

The surface of the silica glass substrate 2 has a mirror finished surface whose surface roughness is maintained at 30 nmRy.

Figure 2:
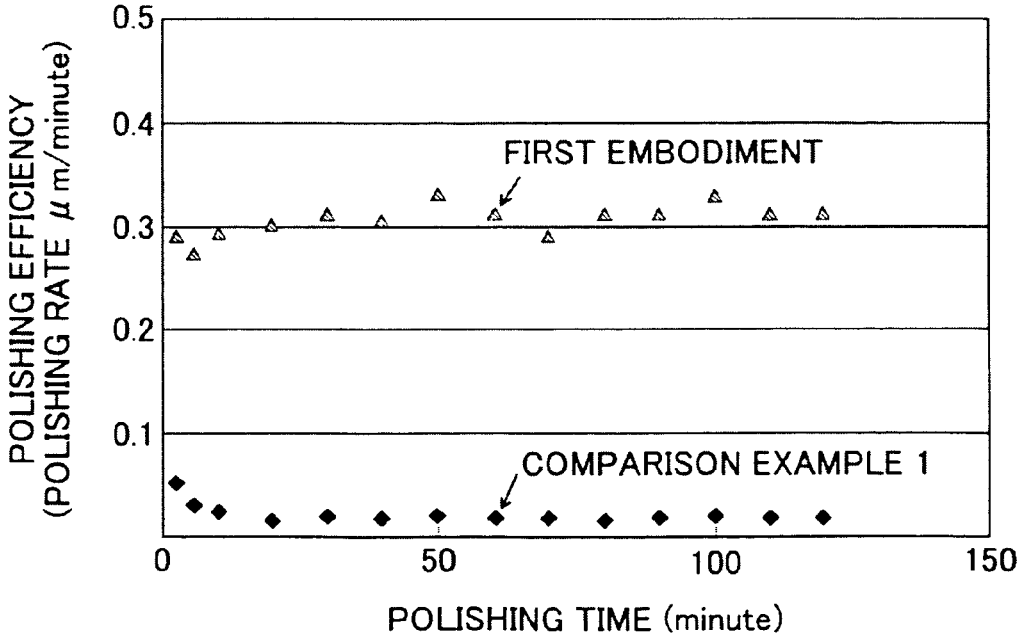
FIG. 2 is a graph showing polishing efficiency.
Figure 3B:
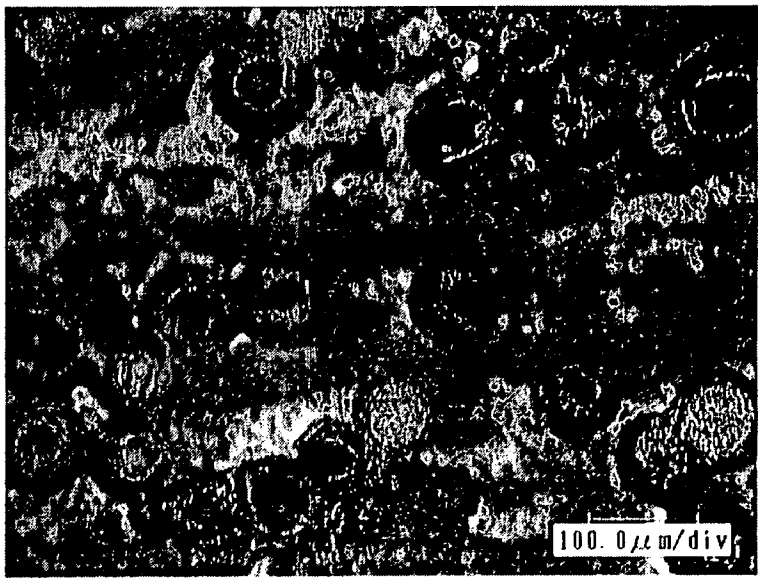
FIG. 3B is a photograph showing the surface of the fixed abrasive grain polishing tool after polishing the work piece for 130 minutes.
Figure 3A:
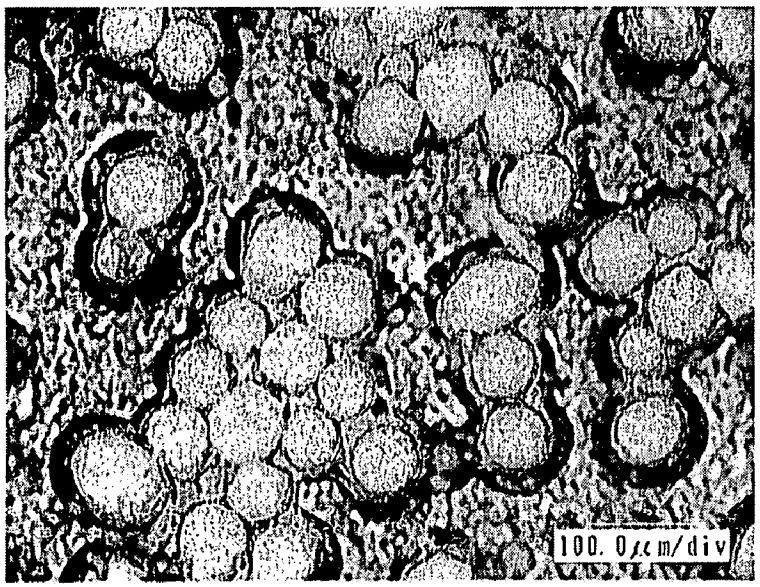
FIG. 3A is a photograph showing the surface of a fixed abrasive grain polishing tool after polishing a work piece for 120 minutes.

FIG. 2 is a graph showing polishing efficiency. As shown in FIG. 2, the polishing efficiency (rate of removal) of the first embodiment is not degraded even after polishing for 120 minutes. FIG. 3A is a photograph showing the surface of the fixed abrasive grain polishing tool 3 after polishing the work piece 2 for 120 minutes. FIG. 3B is a photograph showing the surface of the fixed abrasive grain polishing tool 3 after polishing the work piece 2 for 130 minutes. As shown in FIG. 3A, the fixed abrasive grains are flattened by being worn down. That is, from the FIG. 3A, it is understandable that the parts of the fixed abrasive grains 20 with which the silica glass substrate 2 makes contact are round shaped.

Figure 5:
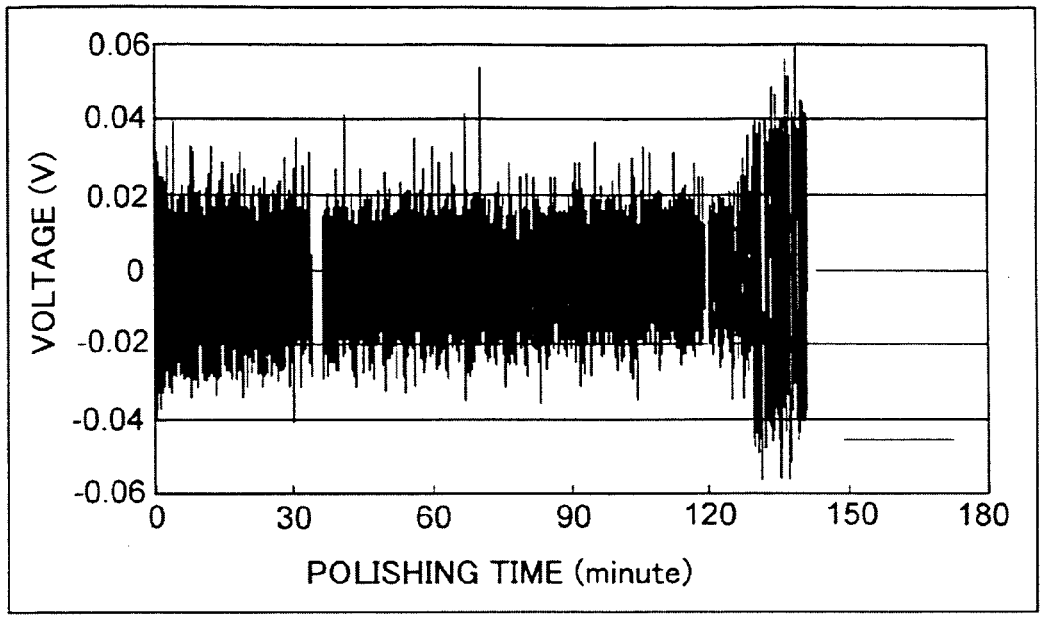
FIG. 5 is a graph showing a changing state of polishing resistance with the passage of time.

FIG. 5 is a graph showing a changing state of polishing resistance with the passage of time. In FIG. 5, polishing resistance data for 140 minutes from starting the polishing are shown as measured by the ammeter 11*s*. However, in FIG. 5, polishing resistance data are shown in voltages, which are converted from the measured result (current). As shown in FIG. 5, the polishing resistance approximately doubles after polishing for 130 minutes. The fixed abrasive grain worn down state after polishing for 130 minutes is shown in the photograph of FIG. 3B. As described above, FIG. 3A shows a state of the fixed abrasive grains after polishing for 120 minutes. When these states are compared with each other, after polishing for 130 minutes shown in FIG. 3B, the round shaped parts of the fixed abrasive grains 20 which the silica glass substrate 2 contacts are greatly deformed. Therefore, it is understandable that the fixed abrasive grains are almost worn out. In addition, the polishing efficiency is sharply lowered after polishing for 130 minutes, and large scratches are observed on the surface of the silica glass substrate 2. Consequently, the fixed abrasive grain polishing tool 3 has not been able to further polish and has to be changed because the deterioration of the polished surface occurs when the fixed abrasive grain polishing tool 3 continues to be used as it is.

As described above, it is learned that the great increase of the polishing resistance is caused by the worn down state of the fixed abrasive grains. However, in the actual polishing process, it is troublesome to determine the changing time of the polishing tool by observing the worn down state of the fixed abrasive grains by stopping the polishing process.

However, when the worn down state of the fixed abrasive grains is monitored, the changing timing of the polishing tool can be obtained. In the first embodiment, the changing time of the polishing tool is after approximate 130 minutes of polishing time.

Figure 9:
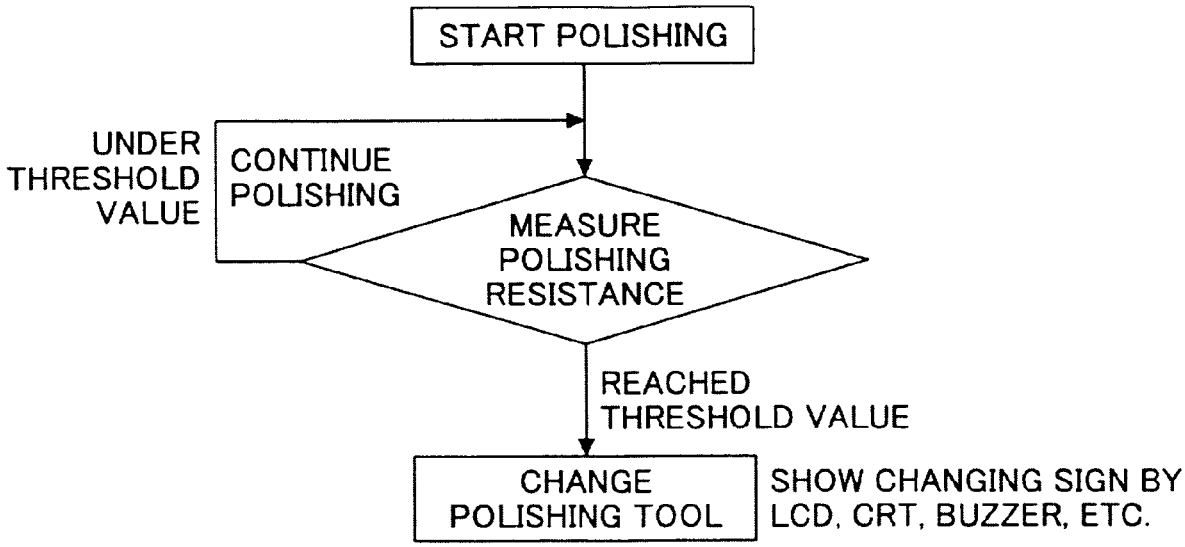
FIG. 9 is a flowchart showing control processes to decide the changing timing of the polishing tool.

FIG. 9 is a flowchart showing control processes to decide the changing timing of the polishing tool (fixed abrasive grain polishing tool). In FIG. 9, in the first embodiment, the threshold value can be the polishing resistance at the time when the polishing time reaches 130 minutes. The worn down state (tool service life) of the fixed abrasive grains is different among various conditions. That is, the worn down progressing state of the fixed abrasive grains depends on an object to be polished, polishing conditions, and target quality of the object. Therefore, the threshold value of the polishing resistance is different among them. Therefore, before starting the actual polishing, data showing correlation between the changing amount of the polishing resistance and the worn down progressing state of the fixed abrasive grains are measured, the threshold value is decided, and the changing of the polishing tool is executed by following the flowchart shown in FIG. 9.

COMPARISON EXAMPLE 1

In the comparison example 1, the same surface polishing apparatus 1, the same silica glass substrate 2, and the same fixed abrasive grain polishing tool 3 as those in the first embodiment are used. However, the loose abrasive grain slurry is not supplied.

Figure 6:
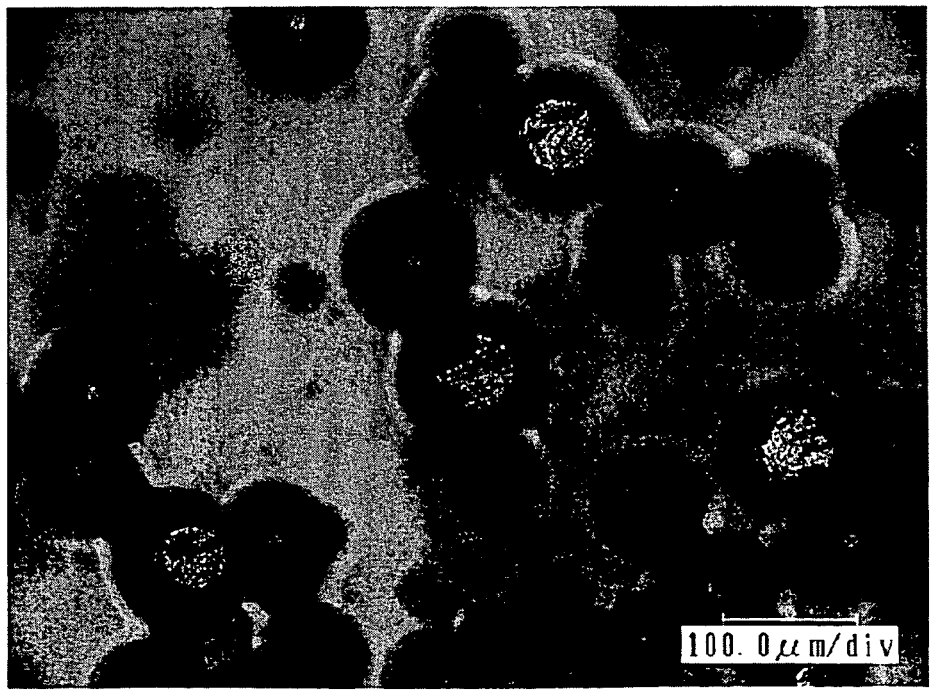
FIG. 6 is a photograph showing the surface of the fixed abrasive grain polishing tool after being used according to a comparison example 1.

In the comparison example 1, during the polishing, the surface roughness and the polishing efficiency are measured at the same predetermined interval as that in the first embodiment. The measured result is shown in FIG. 2. In the comparison example 1, the surface smoothness is not damaged. However, as shown in FIG. 2, the polishing efficiency is far lower than that in the first embodiment. FIG. 6 is a photograph showing the surface of the fixed abrasive grain polishing tool 3 after being used according to the comparison example 1. As shown in FIG. 6, when the worn down state of the tips of the fixed abrasive grains is observed, the areas of the tips of the fixed abrasive grains are small and the number of the worn fixed abrasive grains is few; therefore, it is learned that the wearing down process is very slow. When the comparison example 1 is compared with the first embodiment, it can be seen that supplying the loose abrasive grains causes a dressing effect (accelerating the wearing down of the fixed abrasive grains), and realizes high polishing efficiency.

COMPARISON EXAMPLE 2

Figure 7:
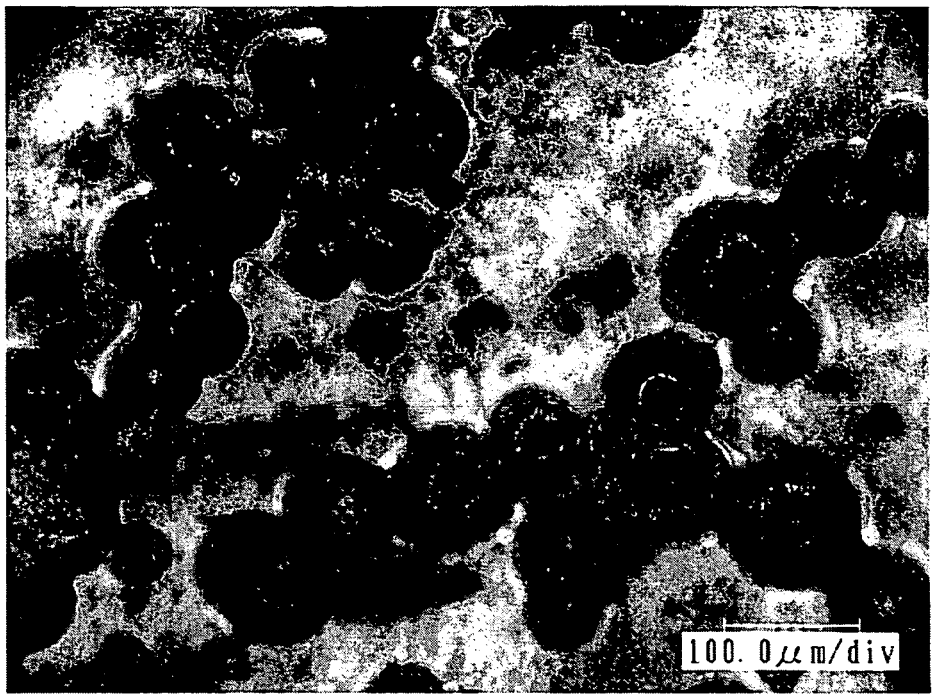
FIG. 7 is a photograph showing the surface of the fixed abrasive grain polishing tool after being used according to a comparison example 2.

In the comparison example 2, the same surface polishing apparatus 1, the same silica glass substrate 2, and the same fixed abrasive grain polishing tool 3 as those in the first embodiment are used. However, as the surface active agent, nitrilotri ethanol is not added to the loose abrasive grain slurry and the polishing is executed. FIG. 7 is a photograph showing the surface of the fixed abrasive grain polishing tool 3 after being used according to the comparison example 2. As shown in FIG. 7, when the surface of the fixed abrasive grain polishing tool 3 is observed after being used for 30 minutes, it is learned that the number of dropping abrasive grains is very large. In addition, it is confirmed that scratches considered to be caused by the dropped abrasive grains exist on the surface of the silica glass substrate 2.

From the difference between the first embodiment and the comparison example 2, it is confirmed that the dressing effect for the tips of the fixed abrasive grains is remarkably shown by restraining the loose abrasive grains from being precipitated with the addition of the surface active agent.

COMPARISON EXAMPLE 3

In the comparison example 3, the fixed abrasive grains of the first embodiment are replaced by general single grain zirconium oxide abrasive grains (average grain diameter is 50 μm; a product of Nippon Denko Corp.) and a fixed abrasive grain polishing tool is made and the polishing of the surface of the silica glass substrate 2 is executed by using the surface polishing apparatus 1 and the fixed abrasive grain polishing tool. In the polishing by the comparison example 3, the worn down state of the tips of the fixed abrasive grains is not observed. However, it is confirmed that many scratches are formed on the surface of the silica glass substrate 2.

From the difference between the first embodiment and the comparison example 3, when the fixed abrasive grain polishing tool 3 is made of a porous substance of granule type, in which the many primary grains are partially bonded with each other with spaces among them, without the porous substance containing a binder in it, it is learned that the dressing effect on the tips of the fixed abrasive grains by the loose abrasive grains is surely obtained.

Figure 4A:
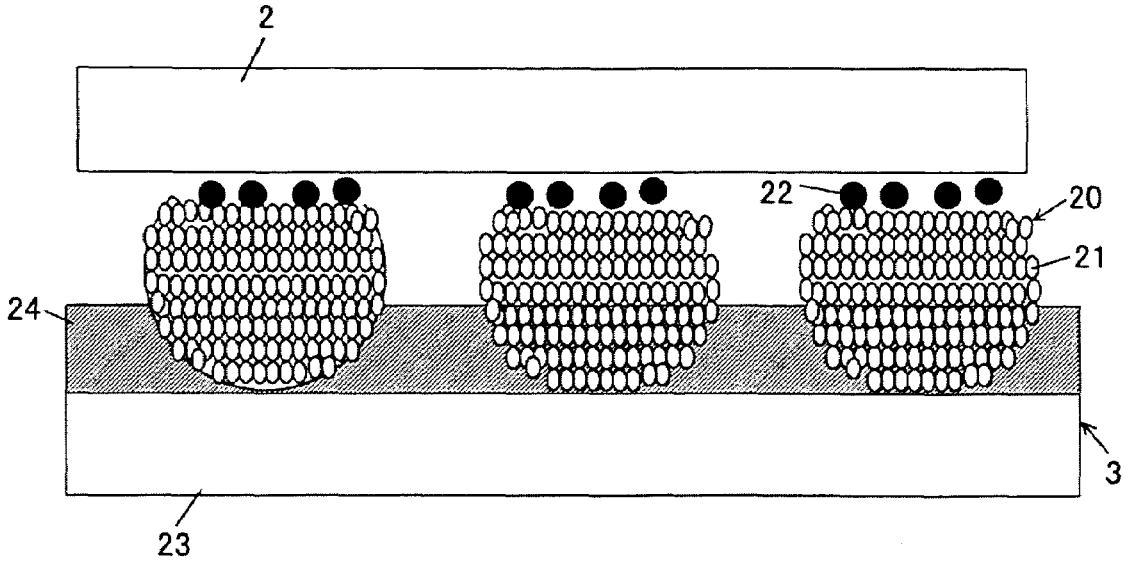
FIG. 4A is a schematic side diagram showing a state in which the surface of the fixed abrasive grain polishing tool is dressed by loose abrasive grains.

FIG. 4A is a schematic side diagram showing a state in which the surface of the substrate 2 is polished by loose abrasive grains 22. As shown in FIG. 4A, the first embodiment is different from the comparison example 3 based on the conventional technology, in that supplying the loose abrasive grains 22 accelerates the wearing down of the tips of the fixed abrasive grains 20, that is, the wearing down of the parts of the fixed abrasive grains 20 which polish the surface of the work piece to be polished is obtained by the loose abrasive grains 22. By the mixed effect with the loose abrasive grains 22, the generation of fine cutting edges is always obtained to work on the surface to be polished. With this, high polishing efficiency is maintained for a long time.

Figure 4B:
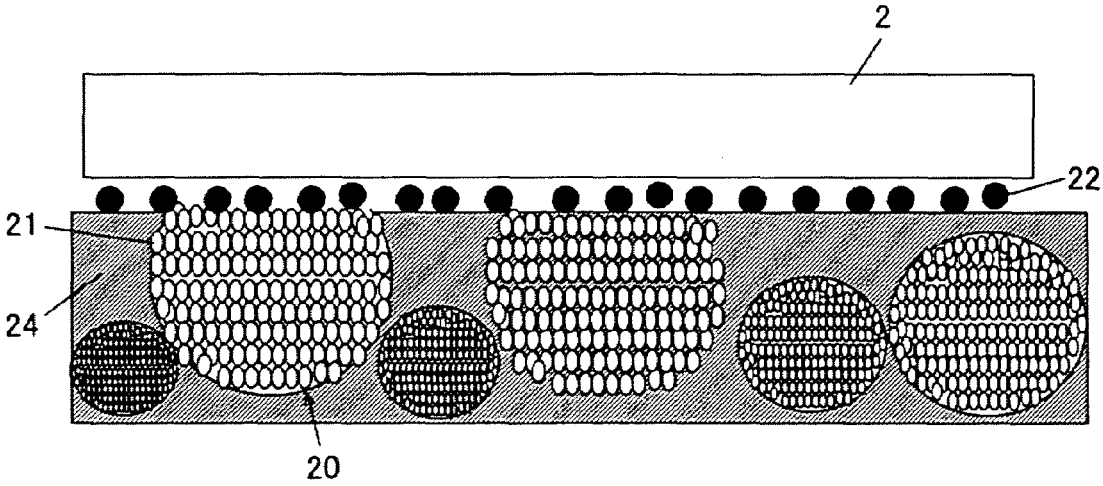
FIG. 4B is a schematic side diagram showing a state in which the surface of a polishing tool being a polishing cloth (pad) or a grinding stone is dressed by the loose abrasive grains.

FIG. 4B is a schematic side diagram showing a state in which the surface of a polishing tool being a polishing cloth (pad) or a grinding stone is dressed by loose abrasive grains. As shown in FIG. 4B, when the work piece 2 is polished, the binder 24 and the fixed abrasive grains 20 are dressed at the same time, and the tips of the fixed abrasive grains 20 are dressed without dropping from the binder 24. In the case of the polishing cloth or the grinding stone, the same polishing characteristics as those in the first embodiment are obtained.

SECOND EMBODIMENT

Figure 8:
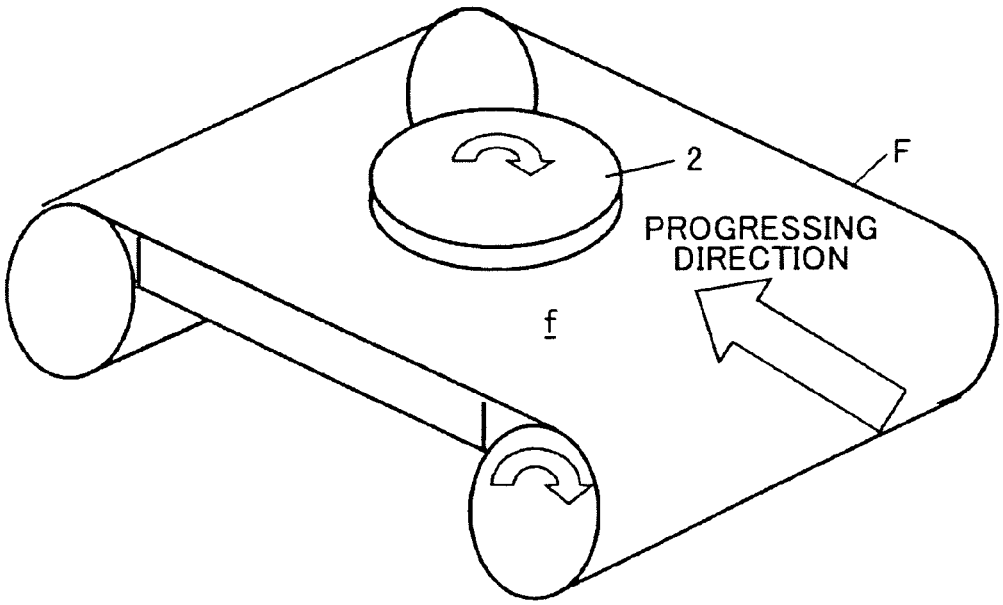
FIG. 8 is a schematic perspective view of a surface polishing apparatus according to a second embodiment of the present invention.

FIG. 8 is a schematic perspective view of a surface polishing apparatus according to the second embodiment of the present invention. As shown in FIG. 8, in the second embodiment, a progressive mechanism of a fixed abrasive grain polishing film F is used. That is, similar to the first embodiment, the work piece 2 is rotated and polishing the surface of the work piece 2 and dressing the tips of fixed abrasive grains of the film F are simultaneously executed by supplying loose abrasive grain slurry on a polishing surface "f" of the fixed abrasive grain polishing film F with a surface active agent. During the polishing of the surface of the work piece 2 by the polishing surface "f" of the fixed abrasive grain polishing film F, a new part of the polishing surface "f" is formed on the surface to be polished of the work piece 2 corresponding to the worn down state of the fixed abrasive grains of the polishing surface "f". That is, when the polishing resistance exceeds a predetermined threshold value, the polishing of the surface of the work piece 2 is stopped, after the new part of the film F is fed, the polishing of the surface of the work piece 2 is started again.

According to the second embodiment, a changing operation of the polishing film which is conventionally required is not needed. In addition, the same polishing result as that of the first embodiment is obtained in the second embodiment.

The results of the first and second embodiments of the present invention and the comparison examples 1 to 3 are shown in the following Table 1.

TABLE 1

| | POLISHING EFFICIENCY | POLISHED SURFACE QUALITY | WORN STATE OF FIXED ABRASIVE GRAINS |
|---|---|---|---|
| FIRST EMBODIMENT | HIGH, STABLE, FOR LONG TIME | EXCELLENT | TIPS ARE CONTINUOUSLY WORN DOWN |
| SECOND EMBODIMENT | HIGH, STABLE, FOR LONG TIME | EXCELLENT | TIPS ARE CONTINUOUSLY WORN DOWN |
| COMPARISON EXAMPLE 1 | LOW | GOOD | STANDSTILL |
| COMPARISON EXAMPLE 2 | LOW | BAD | GRAINS ARE DROPPED |
| COMPARISON EXAMPLE 3 | HIGH | WORST | NOT WORN DOWN |

EFFECT OF THE INVENTION

According to embodiments of the present invention, new fine edges are always formed in the surface of the fixed abrasive grain polishing tool, and the polishing process by the fixed abrasive grains and the loose abrasive grains can be applied on a surface to be polished of an object. Therefore, the polishing process can be stably executed at high efficiency with high polished quality for a long time.

In addition, the precipitation of the loose abrasive grains is restrained, the loose abrasive grains are surely held on the tips of the fixed abrasive grains, and the tips of the fixed abrasive grains are worn down and flattened by the loose abrasive grains. Therefore, clogging of the abrasive grains by swarf and dropping of the abrasive grains that conventionally occur can be restrained.

In addition, since the compression to failure strength of the fixed abrasive grains is adjusted in a range between 20 MPa and 160 MPa, the tips of the fixed abrasive grains can be worn down and flattened by the loose abrasive grains. When the compression to failure strength is less than 20 MPa, the fixed abrasive grains do not work well due to being drastically worn down. When the compression to failure strength is more than 160 MPa, the tips of the fixed abrasive grains are not well worn, new fine cutting edges are not formed on the surface to be polished, and scratches may be generated. Further, since the average diameter of the fixed abrasive grains is 20 μm to 200 μm, a sufficient sticking out amount of the fixed abrasive grains can be obtained.

In addition, since the worn down state of the fixed abrasive grain polishing tool can be obtained, the changing timing of the fixed abrasive polishing tool or the progressing speed of the fixed abrasive grain polishing tool can be simply controlled. Consequently, cost of the polishing process can be greatly reduced.

Further, the present invention is not limited to the specifically disclosed embodiments, and variations and modifications may be made without departing from the scope of the present invention.

The present invention is based on Japanese Priority Patent Application No. 2005-008335, filed on Jan. 14, 2005, with the Japanese Patent Office, the entire contents of which are hereby incorporated by reference.

What is claimed is:

1. A surface polishing method that polishes the surface of a hard brittle material, such as a glass substrate, an oxide film of a silicon wafer, and a ceramic substrate, wherein:

a fixed abrasive grain polishing tool is used, in which fixed abrasive grains are a porous substance of granule type in which many primary grains are partially bonded with each other with spaces among them without having the binder therein, and the surface polishing method comprising the steps of:

supplying loose abrasive grain slurry between the fixed abrasive grain polishing tool and a surface to be polished of an object; and dressing top parts of the fixed abrasive grains of the fixed abrasive grain polishing tool which top parts contact the surface to be polished of the object by the supplied loose abrasive grains, wherein the fixed abrasive grains have a compression to failure strength that is 20 MPa to 160 MPa, wherein an average diameter of the fixed abrasive grains is 20 μm to 300 μm, wherein a maximum height of a roughness carved parameter Rz is 10 μm to 120 μm at a polishing surface of the fixed abrasive grain polishing tool, and wherein the abrasive grains in the fixed abrasive grain polishing tool are made of zirconium oxide ($ZrO_2$), and the loose abrasive grains in the loose abrasive grain slurry are made of cerium oxide ($CeO_2$).

2. The surface polishing method as claimed in claim 1, wherein:

a surface active agent is added to the loose abrasive grain slurry.

3. The surface polishing method as claimed in claim 2, wherein:

the surface active agent is one of nitrilotri ethanol, stearic acid, alkanolamine, and glycerinester, or a mixed agent that mixes two or more thereof.

4. A surface polishing method for polishing a surface of a hard brittle material, said method comprising:

providing a fixed abrasive grain polishing tool having fixed abrasive grains that are a porous substance of granule type in which primary grains are partially bonded with each other with spaces among them without having binder therein;

supplying loose abrasive grain slurry between the fixed abrasive grain polishing tool and a surface of an object to be polished; and dressing top parts of the fixed abrasive grains of the fixed abrasive grain polishing tool which top parts contact the surface of the object to be polished by supplied loose abrasive grains in the loose abrasive grain slurry, wherein the fixed abrasive grains have a compression to failure strength of 20 MPa to 160 MPa, wherein the fixed abrasive grains have an average diameter of 20 μm to 300 μm, wherein a maximum height of a roughness carved parameter is 10 μm to 120 μm at a polishing surface of the fixed abrasive grain polishing tool, and wherein the fixed abrasive grains in the fixed abrasive grain polishing tool are made of zirconium oxide ($ZrO_2$), and the loose abrasive grains in the loose abrasive grain slurry are made of cenum oxide ($CeO_2$).

5. The surface polishing method as claimed in claim 4, further comprising adding a surface active agent to the loose abrasive grain slurry.

6. The surface polishing method as claimed in claim 5, wherein the surface active agent is one of nitrilotri ethanol, stearic acid, alkanolamine, and glycerinester, or a mixed agent that mixes two or more thereof.

* * * * *